United States Patent [19]

Swartz

[11] 4,274,321

[45] Jun. 23, 1981

[54] HARMONY AUTHORIZATION DETECTOR SYNTHESIZER

[76] Inventor: Jerome Swartz, 2 Marwood Pl., Stony Brook, N.Y. 11790

[21] Appl. No.: 61,854

[22] Filed: Jul. 30, 1979

[51] Int. Cl.[3] ..... G10H 1/38; G10H 3/18; G10H 5/00

[52] U.S. Cl. ..... 84/1.03; 84/1.09; 84/1.13; 84/1.16; 84/1.26; 84/1.27; 84/DIG. 22

[58] Field of Search ..... 84/1.01, 1.03, 1.04, 84/1.06, 1.09–1.16, 1.19, 1.21, 1.22, 1.24, 1.26, 1.27, DIG. 9, DIG. 22

[56] References Cited

U.S. PATENT DOCUMENTS

| | | | |
|---|---|---|---|
| 3,591,699 | 7/1971 | Cutler | 84/1.11 |
| 3,711,618 | 1/1973 | Freeman | 84/1.03 |
| 3,911,776 | 10/1975 | Beigel | 84/1.11 |
| 3,948,138 | 4/1976 | Gunn et al. | 84/1.1 X |
| 4,119,005 | 10/1978 | Kondo et al. | 84/1.01 |
| 4,205,576 | 6/1980 | Deutsch et al. | 84/DIG. 22 |

*Primary Examiner*—Stanley J. Witkowski
*Attorney, Agent, or Firm*—Kirschstein, Kirschstein, Ottinger & Cobrin

[57] ABSTRACT

A harmony authorization detector (HAD) synthesizer electronically generates single audible musical notes in harmony with single original aural notes of a melody as the melody is played on an instrument by a single player. Thus the HAD functions as, in effect, a second instrument electronically operational in harmony with a manually played lead instrument. The HAD synthesizer is particularly useful with guitars although not so limited. When a lead electronic guitar is used in a solo situation playing one original note at a time, the HAD synthesizer will, for each string on each position of the guitar and with the aid of a group of tone decoders, electronically detect the single fundamental note played by the guitarist and will authorize the emission of a preset, predetermined electronically generated synthesized single harmony note e.g. a third, fifth, seventh, etc. based on the fundamental of the single note played by the lead guitarist. The original electronic note played plus the synthesized electronic harmony note are amplified and led to a speaker system where they are transduced into aural notes. The HAD synthesizer covers at least about two octaves for each string of the guitar with which it is to be associated and will function harmonically true on ascending and descending scales. The synthesized harmony note sustains for about the same period of time, e.g. as a congruent envelope configuration of amplitude versus time, and is of approximately the same instrumental quality (timbre), as the original note. The HAD synthesizer has a control to enable the player to preselect the synthesized electronically generated harmony notes, whereby to permit the player to decide on the harmony which he desires for his electronic accompanist. The HAD synthesizer can produce harmony corresponding to a variety of instruments by controlling said envelope configuration and the harmonic content of said electronically generated single harmony note.

12 Claims, 4 Drawing Figures

OUTPUT GAIN CONTROL STAGE
GATED CONTROL STAGE
GROUP OF GATED CONTROL STAGES 40
GROUP OF TONE DECODERS 32
TONE DECODER
GROUP OF TONE GENERATORS 42
TONE GENERATOR
PICK UP 24
OUT

HARMONY AUTHORIZATION DETECTOR SYNTHESIZER

BACKGROUND OF THE INVENTION

1. Field of the Invention

This invention relates to a harmony authorization detector synthesizer, that is to say, a device that will, responsive to a single original note that is detected by the synthesizer, electronically authorize the emission of an electronically generated single note in harmony with the original note.

2. Description of the Prior Art

No directly relevant prior art is known in which for each single (original) note a harmony note is generated in combination therewith, nor, particularly, in which the harmony note experiences a predetermined decay and is selectable as to timbre, nor as to which the harmony note has an amplitude that is a function of the amplitude of the original note, nor as to which the harmony note is selectable as to the type of harmony desired.

There are prior art patents in which original notes are analyzed to determine the fundamental tones in the absence of harmonics and which notes subsequently are modified by the addition of overtones to change the color (timbre) of the note so, as an example, to make the note resemble different instruments or even the human voice. However, such patents pertain to "harmonics" which are modifications of an original voiced note but are not new notes in "harmony" with an original voiced note; hence such art is not deemed to be relevant.

SUMMARY OF THE INVENTION

PURPOSES OF THE INVENTION

It is an object of the invention to provide a HAD synthesizer that will electronically provide a single note type of harmony accompaniment for a melody consisting of a series of single original notes played by a musician.

It is another object of the invention to provide a HAD synthesizer that will create an electronic harmony accompaniment for a lead musician who is playing on an instrument a melody consisting of a series of single original notes.

It is another object of the invention to provide a HAD synthesizer of the character described in which the harmony note experiences a predetermined decay preferably matching that of the original note.

It is another object of the invention to provide a HAD synthesizer of the character described in which the harmony notes generated may be selectable as to timbre.

It is another object of the invention to provide a HAD synthesizer of the character described in which the harmony note has an amplitude that is a function of or matches the amplitude of the original note.

It is another object of the invention to provide a HAD synthesizer of the character described in which the harmony notes voiced can be selected by the player as to the type of harmony desired, for example thirds, fifths, sevenths, etc.

Other objects of the invention in part will be obvious and in part will be pointed out hereinafter.

BRIEF DESCRIPTION OF THE INVENTION

The HAD synthesizer includes an input amplifier which feeds a decoding stage that includes a group of tone decoders. Each tone decoder constitutes a different detection circuit tuned to a different preselected fundamental electronic note, i.e. a pure frequency. Each tone decoder will emit a pulse when the input to the decoder is of the preselected frequency within a small tolerance, such as the tolerance that is acceptable in a musical rendition. There is one different tone decoder for each original note to be detected on the instrument being played by the musician. Thus, the decoding stage, for each different single original note played by the musician, will generate a selected one of a group of different pulses. Furthermore, the HAD synthesizer includes a group of continuously operating tone generators. There is a different tone generator associated with each different original aural note. Each different tone generator, as long as the HAD synthesizer is energized, continuously generates a wave of constant amplitude at a frequency that harmonizes with the associated original aural note, there being but one tone generator for each tone decoder and hence for each original note. Additionally the HAD synthesizer includes a group of gates, i.e. triggers. There is a different gate for each different tone generator. When a specific original note played by a musician is detected by a decoder, the pulse emitted by that decoder gates on (triggers) its associated tone generator, or, phrased differently, "authorizes" passage of the output of the associated tone generator to produce an output electronic tone, i.e. a sustained electronic signal, at an electronic frequency that harmonizes (is in harmony) with the specific original note played by the musician. Each gate is normally off and receipt of a pulse not only will gate the output of the associated tone generator but also will generate an exponentially decaying wave form of predetermined configuration which is employed to modify the constant amplitude of said generator so as to produce a harmony accompanying note which not only is in harmony with the original note played but also dies away in a wave form envelope that matches the envelope of decay of the original note. If the HAD synthesizer is used with a guitar, the decay time will approximately match the decay time of a guitar string.

Finally, the HAD synthesizer has a gain control output amplifier stage which is regulated as to gain, and hence amplitude, by a signal derived from the input amplifier, whereby the harmony output signal has an amplitude that follows the amplitude of the original note played by the musician. The output signal from the output amplifier stage is combined with the output signal from the input amplifier which amplified the original note played by the musician. The combined signals are lead to an audio transducer such as a loud speaker system.

Each tone generator may be arranged to supply wave forms of different shapes and resultant harmonic contents to be selected by the player according to his desire for the most pleasing sound for the particular instrument, and moreover the tone generators may be arranged and connected to the gates in such a fashion that the harmony notes played may be selected by the musician to play harmonies of different kinds such as thirds, fifths, sevenths, etc.

The invention accordingly consists in the features of construction, combinations of elements and arrangements of parts shown in the accompanying drawings and hereinafter described, all as set forth in the accompanying claims.

BRIEF DESCRIPTION OF THE DRAWINGS

In the accompanying drawings, in which are shown various possible embodiments of the invention.

DESCRIPTION OF THE PREFERRED EMBODIMENTS

Figure 1:
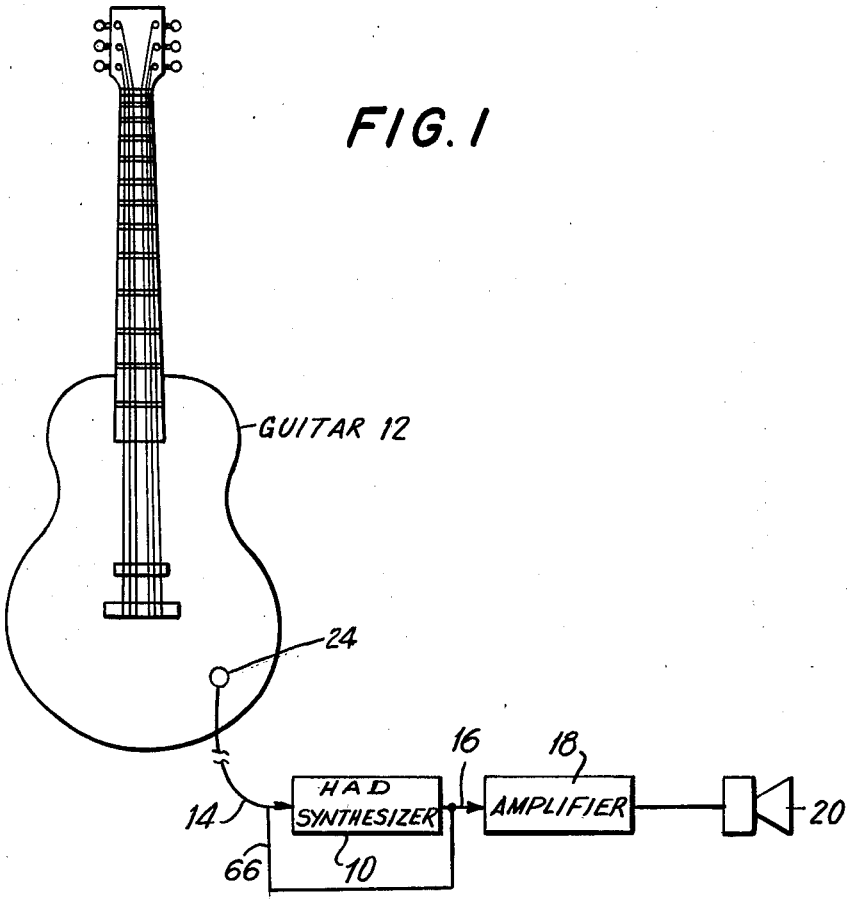
FIG. 1 is a schematic diagram of a guitar used with a HAD synthesizer embodying the present invention.

In FIG. 1 the reference numeral 10 denotes a HAD synthesizer which will be described in detail hereinafter. The HAD synthesizer is used to provide harmony notes for an instrument and in effect, serve as a substitute player of a harmony for a melody played by a musician. The instrument shown is a stringed instrument, e.g. a guitar 12. A central pickup can be used or each string of the guitar can be provided with a pickup (not shown, of well known form) see for example the pickup shown in FIGS. 1(*a*) of U.S. Pat. No. 3,591,699. A four or six string guitar can be provided with four or six pickups, a different one for each different string. The output(s) from the pickup(s) are fed over a common line 14 to an input for the HAD synthesizer 10. The output from the HAD synthesizer is fed over an output line 16 to amplifier 18, which feeds a loud speaker system 20.

Putting to one side for the moment the details of the HAD synthesizer, said synthesizer includes suitable electronic components which function to produce for each single original note played by the musician on the guitar 12 a single note in harmony with that single note, the original played and harmony played note being combined, amplified in the amplifier 18 and played audibly over the loud speaker system 20.

A distinction must be observed in connection with the understanding of this invention between the term "harmony" or "harmony note" and the terms "harmonics" or "overtones". A "harmony" note is a note or tone which has a frequency (content) that harmonizes with an original note played by a musician. It is not an enriching of the original note, nor is it a modification of the original note, for example, to change its quality or timbre or richness. Thus, a second or harmony guitar played by a musician following a lead musician will have played thereon notes that are in harmony with the original melody notes played by the lead musician. The harmony notes are in accordance with accepted musical theory. For example, a harmony may consist of thirds, fifths, sevenths, ninths, thirteenths, etc. of the original notes. More specifically, if a lead musician plays the note A, a note harmonizing with A in thirds is C or harmonizing therewith in fifths is E, etc.

A "harmonic" note is of a frequency which is an integral multiple of a fundamental (original) note. Successively higher order harmonics are of lower amplitude or energy content. The fundamental is the base or lowest frequency and is sometimes referred to as the first harmonic. No given note in nature is a pure fundamental rather it is a note whose main energy content is essentially in the first harmonic. Thus, "harmonics" will be generated when a string of a musical instrument is set into vibration and the specific "harmonics" will depend upon the mode of vibration and the number of node points in the string as it vibrates, or upon the specific instrument. A "harmonic", although deriving from the same root as "harmony", is not to be confused therewith because harmonics usually are generated by the same vibrating element as that generating a fundamental note; whereas a note in "harmony" with a fundamental note usually is generated by a different instrument and is not at a frequency which is an integral multiple of the frequency of the fundamental. A human voice furnishes a good example of the distinction here being made. A human voice is a very complex sound. It includes many harmonious overtones of a fundamental and is complicated by the different shapes of the sundry aural tones at the sundry frequencies. A second human voice singing in harmony with a lead human voice likewise is complex, as is the lead voice, but the voice singing in harmony is singing different complex notes than the lead voice.

The HAD synthesizer generates the complex harmony notes essential, concurrently with the complex lead notes (keyed to the corresponding fundamental), there being only an unobservable delay in the generation and voicing of the harmony notes although a delay factor can be introduced. Preferably the HAD synthesizer will generate a harmony note so long as the lead (original) note is being generated and has not been permitted to decay. Moreover, the harmony note as generated by the HAD synthesizer will decay as the lead note decays and over a matching period of time so that to the audience the HAD synthesizer creates the impression of a harmonizing accompanist giving the aural, but not visual, effect that two instruments are being played of which the first is the visible lead instrument and the second is an invisible harmony instrument.

Figure 2:
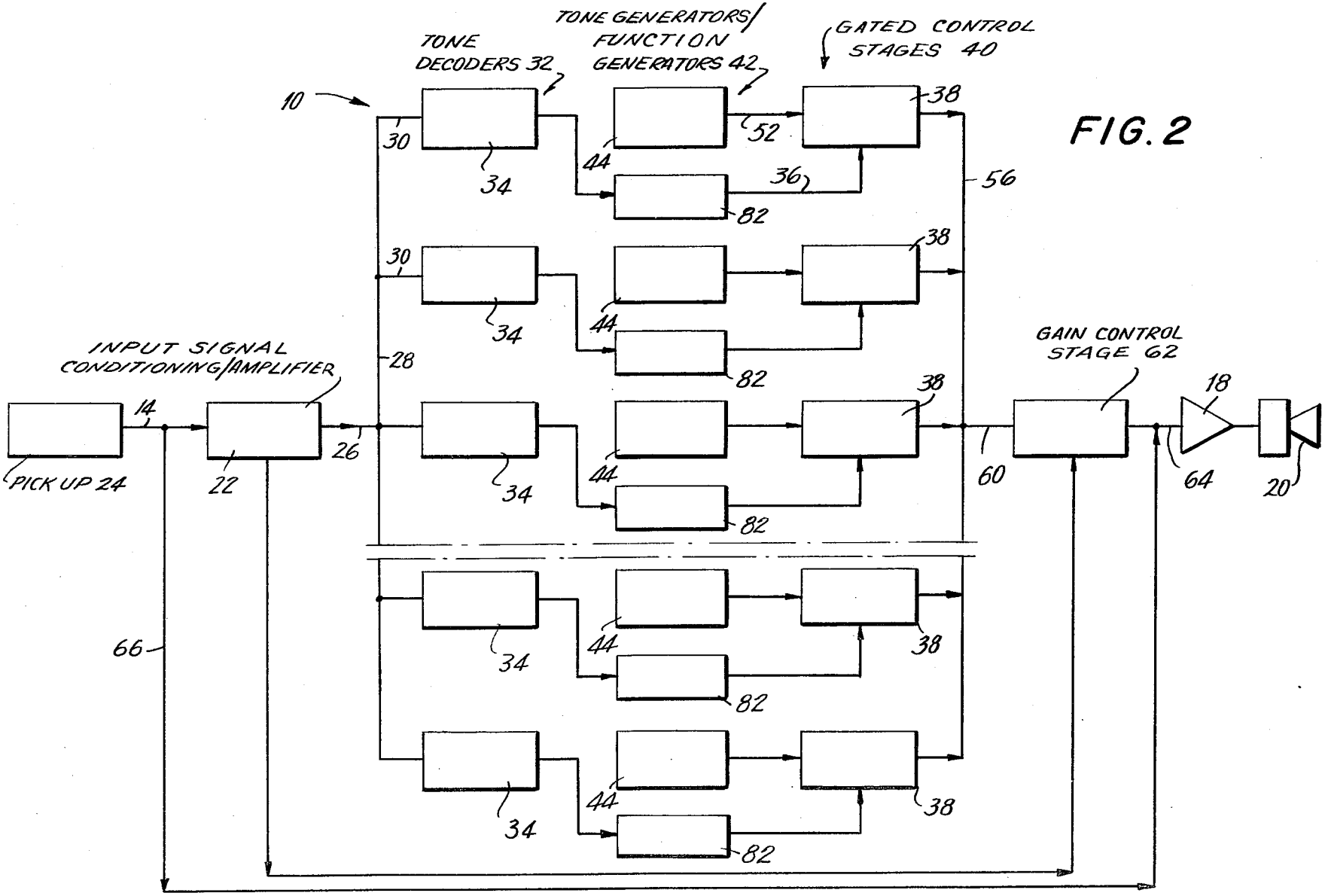
FIG. 2 is a block diagram of a HAD synthesizer.
Figure 3:
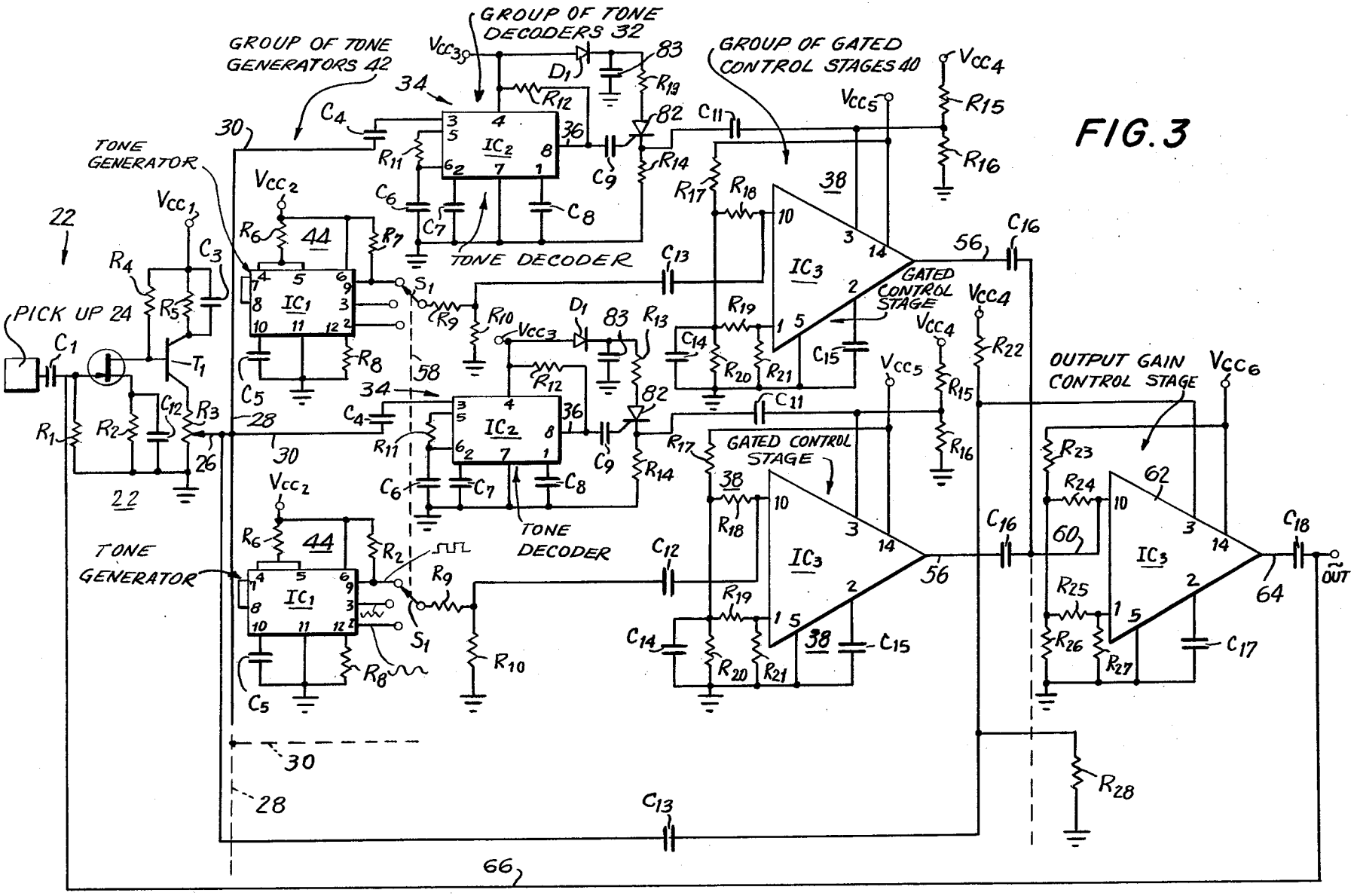
FIG. 3 is a detailed electronic circuit of the HAD synthesizer, the same illustrating the electronic components of the different blocks of FIG. 2.

Referring now to FIG. 2, a block diagram for the HAD synthesizer is illustrated. As therein shown, the HAD synthesizer includes an input signal conditioning amplifier 22 which receives the electronic form of a lead note being played on the guitar which note is transduced from aural form into electronic signal via a pickup 24 which is a singular or one of plural pickups on the guitar 12. The electric signal from the pickup is transmitted to the amplifier 22 over the line 14. The amplifier 22 is a broadband class A RC amplifier one of whose necessary functions is that of impedance matching between the pickup 24 and a tone decoder stage that follows the amplifier. The amplifier of course also provides as much gain as is necessary and preconditions the input note by attenuating the higher order harmonics in the lead note. The circuit diagram for the amplifier 22 is illustrated in FIG. 3. Typical values and types of the sundry components of the amplifier 22 are listed hereinafter.

A lead line 26 connects the output of the amplifier 22 to a bus line 28 which has branch lines 30 running to a tone decoder stage constituting a group of tone decoders 34. There are a large number of decoders, a different tone decoder being provided for each possible fundamental note that may be played on each string of the instrument, e.g. the guitar 12. Inasmuch as all the tone decoders 34 desirably are of the same construction except for their filter frequencies keying to the fundamental of the various guitar notes, they have not been detailed except to the extent of the circuitry thereof which is shown in FIG. 3. Each different tone decoder is tuned to a different pure electric frequency corresponding to the fundamental frequency of the notes that will be played on the instrument. Thus, if it is possible to play 50 original notes (over several octaves) there will be 50 different tone decoders each tuned to a different fundamental frequency. The tone decoders have a reasonably high sensitivity of tuning (i.e. narrow bandwidth filter) but they selectively will be responsive to normal mistuning and sliding action on an instrument. When an electrical signal corresponding to an original note generated by a pickup is amplified by the amplifier 22 and fed through the bus line and branch lines to the sundry decoders, assuming the instrument to be reasonably tuned, one and only one tone decoder will be actuated by that original note to be thus detected. Such actuation of a given tone decoder will turn on, which is to say cause the tone decoder to produce, an output which constitutes a signal.

The signal from the decoder is fed over a line 36 to an associated gated control stage, i.e., trigger 38, through an SCR interface 82 which creates the desired decay wave envelope for the generated harmony tone. A group 40 of such gated control stages is included, a different gated control stage 38 being associated with each different tone decoder 34 so that there is the same number of gated control stages 38 as tone decoders 34. The sundry gated stages 38 are of identical construction, the circuitry therefor being shown in FIG. 3. The values of the sundry electronic components are set forth subsequently. Thus, when a single note played by the lead instrument is detected by a specific tone decoder, which thus identifies that note, the signal emitted thereby will activate the associated gate control stage 38 and all other gated control stages are not turned on. The output from a gated control stage 38 is an exponentially decaying wave form, due to the SCR interface 82. The pulse from the tone decoder output turns on said SCR interface. The DC supply and capacitor 83 cause the anode current to decay below the holding current of the SCR so that it turns off at a corresponding time, e.g., seconds, chosen to correspond to the input note decay and is preset by the RC time constant of the circuit.

Figure 4:
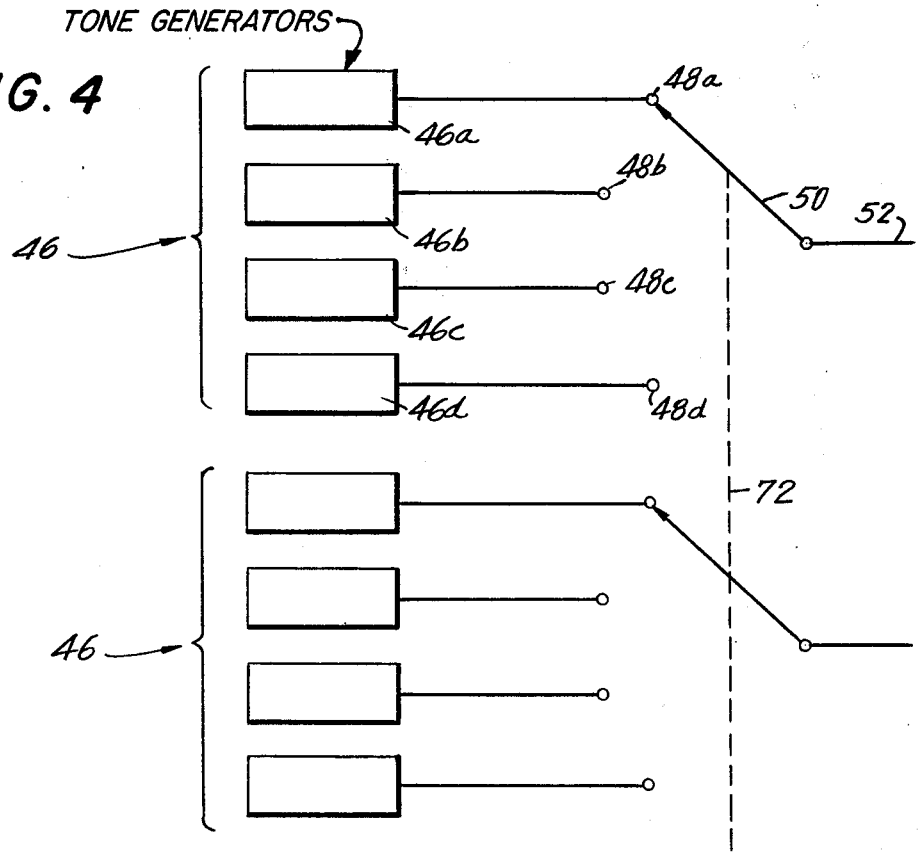
FIG. 4 illustrates a modified block which can be substituted for one of the blocks shown in FIG. 2.

There is one more group of blocks in the HAD synthesizer. It is a group 42 of tone generators 44. In the basic instrument, not including the modification to be described hereinafter with respect to FIG. 4, there are a number of tone generators equal in number to number of tone decoders and to the number of gated signal generators. A tone generator output is activated or gated on as long as the HAD synthesizer is supplied with an input pickup signal which is in the acceptance bandwidth of an associated tone decoder. All of the tone generators are of the same configuration as illustrated in FIG. 3, typical values of the sundry components being given subsequently. There is a different tone generator keyed to each different associated pair of tone decoders and gated control stages so that a specific tone decoder, a specific gated control stage and a specific tone generator function as a triad of associated elements.

A given lead note gates a specific tone generator so long as the HAD synthesizer is turned on, the resulting electronic signal of decaying amplitude and constant pitch being so selected that if aurally transduced it will produce an audible tone which is in harmony with said lead note played by a musician on the instrument.

If the block diagram of FIG. 2 generates a harmony of thirds, for example, if the lead note played is an A, then the harmony note generated will be a C. If the fundamental note played is a B the harmony note generated will be a D. If the fundamental note played is a C the harmony note generated will be an E, etc.

It will be understood, however, that the invention is not to be limited to a harmony of thirds. Thus, in FIG. 4, there are shown subsets 46 of tone generators. The tone generator 46(*a*) of the first subset generates an electric signal having a frequency which if aurally transduced will be a harmony of thirds of an associated fundamental note played by a musician and detected by the associated decoder. The tone generator 46(*b*) generates a signal having a frequency that when aurally transduced will be a harmony of fifths of the associated musical note played. The tone generator 46(*c*) generates a frequency which is a harmony of sevenths of the associated fundamental note played and the tone generator 46(*d*) generates a frequency which is a harmony of ninths of the associated fundamental note played. The same is true of all of the subsets 46 each of which is associated with a different fundamental note that may be played by a musician. The output from each generator common to a subset is led to a terminal 48(*a*), 48(*b*), 48(*c*), 48(*d*), respectively. A tap 50 is provided for each one. The taps of the several subsets are joined for concurrent enablement via a slide bar 72 whose movement jointly will select the same type of harmony tone generator (thirds or fifths, etc.,) for all of the notes played by the musician.

Reverting to FIG. 2 the tone generators are continuously in operation and continuously create electric signals of constant amplitude, the pitch of which is in harmony with the pure note of the associated toner decoder. However, the outputs from tone generators are held back unless they are "authorized", i.e., passed to subsequent portions of the synthesizer which ultimately will render them audible. Specifically, the outputs from the generators are fed over lead lines 52 to the associated gate control stages 38. It will be apparent that each gated control stage has two inputs. One is that of the output signal continuously emanating from the associated tone generator 42 and the other is the signal, when present, issued from the associated tone decoder 32. When a given tone decoder is turned on by sensing the associated fundamental lead note played by a musician it will trigger the associated gated control stage 38 and will permit the continuous signal from the associated tone generator to reach its output branch line 54. Hence the continuous signal on the lead line 52 which up to this point was suppressed because the gated control stage was turned off now is permitted to flow through said gated control stage to a common output line 56.

The gated control stages are more than simply gates; they also function as gain controls. As noted above the gain is in the form of an exponentially decaying curve via SCR 82 which modifies the signal entering the stage 38 from the line 52 so that the signal appearing on the output line 54, although of a frequency of the original note played by the musician, will decay at a rate which approximately matches the decay rate of the instrument. As long as the instrument emits a fundamental note of approximately a given frequency, the amplitude of the signal appearing on the output line 54 will remain constant. But as the note played starts to decay, a corresponding decay will take place in the signal emitted along the line 54. The decay time and configuration of the envelope imposed on the constant amplitude signal in the line 52 approximately matches the decay time envelope of the instrument played.

Desirably, the sundry tone generators may include means to vary the wave forms of the electrical signals generated thereby so as to provide different qualities or timbres. This may be accomplished by incorporating harmonics in the electrical notes generated. Such an arrangement has been illustrated in FIG. 3 by the provision of switch arms $S_1$ designed to engage any one of three taps 2, 3 and 9 on the integrated circuit module $IC_1$ for each tone generator 44. By way of example, when a switch arm $S_1$ is on a tap 2 the tone generator will emit a pure sine wave, when said switch arm $S_1$ is on the tap 3 the tone generator will emit a sawtooth wave, and when said switch arm $S_1$ is on the tap 9 the tone generator will emit a square wave. All of the switch arms $S_1$ for a given tone generator are ganged by a bar 58 so that the same type of wave may be produced by all of the tone generators. The specific waveform for the tone generators will be chosen to optimize a realistic and pleasing sound consonant with the instrument whose harmony is being synthesized. A square wave's harmonic content has been found to yield a transduced sound in excellent correspondence with the lead tone of the guitar.

It will be appreciated from the foregoing that when a musician plays a single note which is transduced by the pick-up into an electrical signal, that is amplified by the amplifier 22, and is fed over the bus line 28 to the sundry branch lines 30, such signal will be identified to the exclusion of all other possible tones by a specific one of the tone decoders 34 which thereupon will turn on a single gated control stage 38 so as to authorize and thereby pass through the gate an associated harmony note in an electrical form emitted by a single associated tone generator 44, the gate 38 concurrently modulating the constant amplitude harmony note so as to cause it to decay exponentially at a rate which matches the decay curve of the instrument played. The harmony note as thus modified thereupon reaches the common output line 56 from the lead 54 associated with the particular gated control that then is turned on. It is finally noted that the various instruments with which the synthesizer may be used are matched to HAD via the SCR amplitude envelope and tone generator in order to produce an optimally pleasing and realistic set of harmonics for said instrument.

The common output line 56 is connected by a lead line 60 to a gain control stage 62 having an output line 64. The gain of the stage 62 is regulated by a signal from the input amplifier 22 whereby the output from the HAD synthesizer will have an output level that corresponds to the input level from the pick-up 24.

A line 66 extends from the pick-up 24 to the input of the amplifier 18 whereby to combine the original note played by the musician with the harmony note derived from the HAD synthesizer. This produces the desired result of creating a composite electrical signal which is a combination of the electricl equivalent of a lead note as played by the musician with an electrical equivalent of the harmony note which, when transduced to audible sound, to the ear will seem to be a note played by an accompanying harmonist in combination with the lead note. The output from the amplifier 18 is fed to the loudspeaker system 20.

The circuitry for the various components diagrammatically indicated by blocks in FIG. 2 have been detailed in FIG. 3 except for the amplifier 18 which is entirely conventional. It will be observed that the connections between the sundry block components of FIG. 2 are capacitatively coupled.

The following values and other identifications are listed for the sundry components of FIG. 3;

| Identification in FIG. 3 | Part Description | Part Identification or Specification |
|---|---|---|
| FET 1 | Field effect transistor (MOT. HEP801) | 2N4222 |
| $T_1$ | Transistor (MOT HEP 51) | 2N1135 |
| $IC_1$ | Signal generator (Internal) | 8038CC |
| $IC_2$ | Tone decoder (Signetics) | 567 |
| $SCR_1$ | Sil. Cont. Rect. (GE) | C106Y2 |
| $D_1$ | Silicone Diode (Motorola) | HEP ROOSO |
| $IC_3$ | AGC (National Semiconductor) | LM 370 |
| $Vcc_1$ | Voltage supply | +9v. 1 ma. |
| $Vcc_2$ | Voltage supply | +12v. 20 ma. |
| $Vcc_3$ | Voltage supply | +9v. 16 ma. |
| $Vcc_4$ | Voltage supply | +9v. 2 ma. |
| $Vcc_5$ | Voltage supply | +12v. 15 ma. |
| $Vcc_6$ | Voltage supply | +12v. 16 ma. |
| $R_1$ | Resistor | 2.2M Ω |
| $R_2$ | Resistor | 4.7K Ω |
| $R_3$ | Potentiometer | 100K Ω |
| $R_4$ | Resistor | 4.7K Ω |
| $R_5$ | Resistor | 100K Ω |
| $R_6$ | Potentiometer | * Ω |
| $R_7$ | Resistor | 5K Ω |
| $R_8$ | Resistor | 81K Ω |
| $R_9$ | Resistor | 10K Ω |
| $R_{10}$ | Resistor | 100 Ω |
| $R_{11}$ | Resistor | * Ω |
| $R_{12}$ | Resistor | 1K Ω |
| $R_{13}$ | Resistor | 10K Ω |
| $R_{14}$ | Potentiometer | 100K Ω |
| $R_{15}$ | Resistor | 5.6 Ω |
| $R_{16}$ | Resistor | 3.3K Ω |
| $R_{17}$ | Resistor | 10K Ω |
| $R_{18}$ | Resistor | 2K Ω |
| $R_{19}$ | Resistor | 2K Ω |
| $R_{20}$ | Resistor | 10K Ω |
| $R_{21}$ | Resistor | 5M Ω |
| $R_{22}$ | Resistor | 5.6K Ω |
| $R_{23}$ | Resistor | 10K Ω |
| $R_{24}$ | Resistor | 2K Ω |
| $R_{25}$ | Resistor | 2K Ω |
| $R_{26}$ | Resistor | 10K Ω |
| $R_{27}$ | Resistor | 5M Ω |
| $R_{28}$ | Resistor | 3.3K Ω |
| $C_1$ | Capacitor | 0.1uf |
| $C_2$ | Electrolytic Capacitor | 5uf |
| $C_3$ | Electrolytic Capacitor | 5uf |
| $C_4$ | Capacitor | 0.1uf |
| $C_5$ | Capacitor | * |
| $C_6$ | Capacitor | * |
| $C_7$ | Capacitor | * |
| $C_8$ | Capacitor | * |
| $C_9$ | Capacitor | 0.1uf |
| 83 | Capacitor | * |
| $C_{11}$ | Capacitor | 0.1uf |
| $C_{12}$ | Capacitor | 2uf |
| $C_{13}$ | Capacitor | 0.1uf |
| $C_{14}$ | Electrolytic Capacitor | 15uf |
| $C_{15}$ | Electrolytic Capacitor | 500uf |
| $C_{16}$ | Electrolytic Capacitor | 2uf |
| $C_{17}$ | Electrolytic Capacitor | 500 |
| $C_{18}$ | Electrolytic Capacitor | 2uf |

*The values employed are appropriately selected to generate specific notes to match those played by a musician and to generate harmony notes for a specific type of harmony corresponding to each note played by the musician.

It thus will be seen that there is provided a device which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention there is claimed as new and desired to be secured by Letters Patent:

1. A harmony synthesizer for use with an instrument that successively has played thereon different single selected original aural notes of a melody to serve as a substitute player of a harmony for a melody played by a musician on said instrument, said synthesizer comprising a transducer for converting a single original aural note at a time emanating from the instrument into an original electric signal retaining at least the fundamental of the wave form of said original aural note, plural means responsive to the original electric signals for emitting for each single original aural note an associated harmony electric signal at a frequency which is in harmony with the fundamental of the original aural note, decay means for modulating the harmony electric signals so that they will fade at approximately the same rate as the single original aural notes, means to regulate the amplitude of the harmony electric signals so that they are functions of the amplitudes of the original electric signals, and means to combine each original electric signal with each associated harmony electric signal so that the two signals can be jointly fed to an output transducer which generates audible sounds from said combined signals.

2. A synthesizer as set forth in claim 1 wherein the means for emitting harmony notes includes means for detecting the fundamental frequencies of electric signals corresponding to single original aural notes, means for generating electric harmony signals the frequencies of which are in harmony with the frequencies of the electric signals, and means responsive to the detecting means for selectively passing to the output transducer successive single harmony signals associated with successive single electric signals.

3. A synthesizer as set forth in claim 1 wherein the means for emitting harmony notes includes means for detecting the frequencies of electric signals corresponding to single original aural notes, means for generating electric harmony signals the frequencies of which are in harmony with the frequencies of the electric signals, and gates responsive to the detecting means for selectively passing to the output transducer successive single harmony signals associated with successive single electric signals.

4. A harmony synthesizer for use with an instrument that successively has played thereon different single selected original aural notes of a melody to serve as a substitute player of a harmony for a melody played by a musician on said instrument, said synthesizer comprising a transducer for converting a single original aural note at a time emanating from the instrument into an original electric signal retaining at least the fundamental of the wave form of said original aural note, plural decoding means for detecting the fundamental frequencies of electric signals corresponding to single original aural notes, plural means for generating different electric harmony signals the frequencies of individual ones of which are in harmony with the frequencies of the different electric signals corresponding to the different single original aural notes, plural means responsive to the detecting means for selectively emitting successive single harmony signals generated by the generating means which successive harmony signals are associated with successive single electric signals, and means to combine each original electric signal with each associated harmony electric signal so that the two signals can be jointly fed to an output transducer which generates audible sounds from said combined signals.

5. A synthesizer as set forth in claim 4 wherein the means responsive to the detecting means for selectively passing electric harmony signals generated by the generating means is a group of gates.

6. A synthesizer as set forth in claim 4 wherein the means responsive to the detecting means for selectively passing electric harmony signals generated by the generating means is a group of gated control stages.

7. A synthesizer as set forth in claim 4 which further includes an input amplifier between the transducer and the detecting means, a gain control output amplifier and means for regulating the gain of said output amplifier as a function of the output from the input amplifier.

8. A synthesizer as set forth in claim 4 which further includes means selectively to vary the type of harmony generated by the harmony generating means, the harmonies thus selected being the same for all of the original notes for a given selection.

9. A synthesizer as set forth in claim 4 which further includes for each means for generating electric harmony signals a group of harmony generating means, the harmony generating means in each group having different wave forms but the same frequency.

10. A synthesizer as set forth in claim 4 wherein the means for generating harmony notes includes a group of tone generators, the detecting means comprises a group of tone decoders, and the means responsive to the detecting means comprises a group of gates, each different generator being associated with a different tone decoder and a different gate to constitute a triad associated with each different single original aural note.

11. In combination, a guitar and a harmonic synthesizer as set forth in claim 10.

12. A synthesizer as set forth in claim 10 wherein the tone decoders have a selectivity responsive to normal mistuning and sliding action on the instrument.

* * * * *